United States Patent [19]

Berkowitz

[11] Patent Number: 4,683,738

[45] Date of Patent: Aug. 4, 1987

[54] FLUSH COMBINATION LOCK

[76] Inventor: Nathan L. Berkowitz, 4762 N. Cumberland Blvd., Milwaukee, Wis. 53211

[21] Appl. No.: 868,691

[22] Filed: May 30, 1986

[51] Int. Cl.[4] ..... E05B 37/08

[52] U.S. Cl. ..... 70/332; 70/285; 70/21

[58] Field of Search ..... 70/332, 333, 21, 22, 70/25, 285; 74/553, 10 R, 45

[56] References Cited

U.S. PATENT DOCUMENTS

| | | | |
|---|---|---|---|
| 677,625 | 7/1901 | Biele | 74/553 |
| 1,166,231 | 12/1915 | Lewis | 70/333 A |
| 2,020,879 | 11/1935 | Eldred | 72/333 A |
| 2,026,932 | 1/1936 | Cisor | 72/332 |
| 3,518,852 | 7/1970 | Orr | 70/332 |
| 3,572,069 | 3/1971 | Junkunc | 70/332 |
| 4,048,821 | 9/1977 | Bako | 70/25 |
| 4,117,785 | 10/1978 | Drescher | 109/59 T |
| 4,422,311 | 12/1983 | Zabel | 72/38 B |

FOREIGN PATENT DOCUMENTS

| | | | |
|---|---|---|---|
| 646211 | 6/1937 | Fed. Rep. of Germany | 70/332 |
| 631819 | 8/1921 | Switzerland | 74/553 |

*Primary Examiner*—Henry E. Raduazo
*Attorney, Agent, or Firm*—Bayard H. Michael

[57] ABSTRACT

The combination lock has a case which contains the lock mechanism including permutation discs. The case is mounted behind and protected by the locker door. An escutcheon plate is mounted on the front of the door with a rotary dial mounted therein. The rim of the dial has indicia to brought into registry with the fixed index on the escutcheon. The dial rim slopes at about 45° to the rotational axis of the dial and this slope deflects lateral blows or impacts. The center of the dial is recessed and has pads engageable by the user to facilitate turning the dial.

5 Claims, 9 Drawing Figures

FLUSH COMBINATION LOCK

BACKGROUND OF THE INVENTION

The usual permutation lock found on lockers in schools and the like has a protruding cylindrical knob which is turned to rotate the numbers on the skirt of the knob in the sequential combination required to open the lock. Most such locks have the lock mechanism including the permutation discs inside the knob. Students have found a well placed kick on the side of the knob will break the knob, destroy the lock and open the locker for inspection. Permutation locks made according to my U.S. Pat. No. 3,395,557 with the lock works including the permutation discs located behind the door were provided with protruding cylindrical knobs which could be destroyed with a well placed kick.

The object of this invention is to provide a permutation lock which is not vulnerable to a kick.

SUMMARY OF THE INVENTION

This invention provides a combination lock having a case which is mounted behind and protected by the locker door. The case contains the lock mechanism including permutation discs. An escutcheon plate is mounted on the front of the door and has a rotary dial mounted therein. The dial has a sloping rim with indicia thereon. The slope deflects lateral blows. The center of the dial is recessed and can be manually engaged to rotate the dial.

DETAILED DESCRIPTION OF THE DRAWINGS

Figure 1:
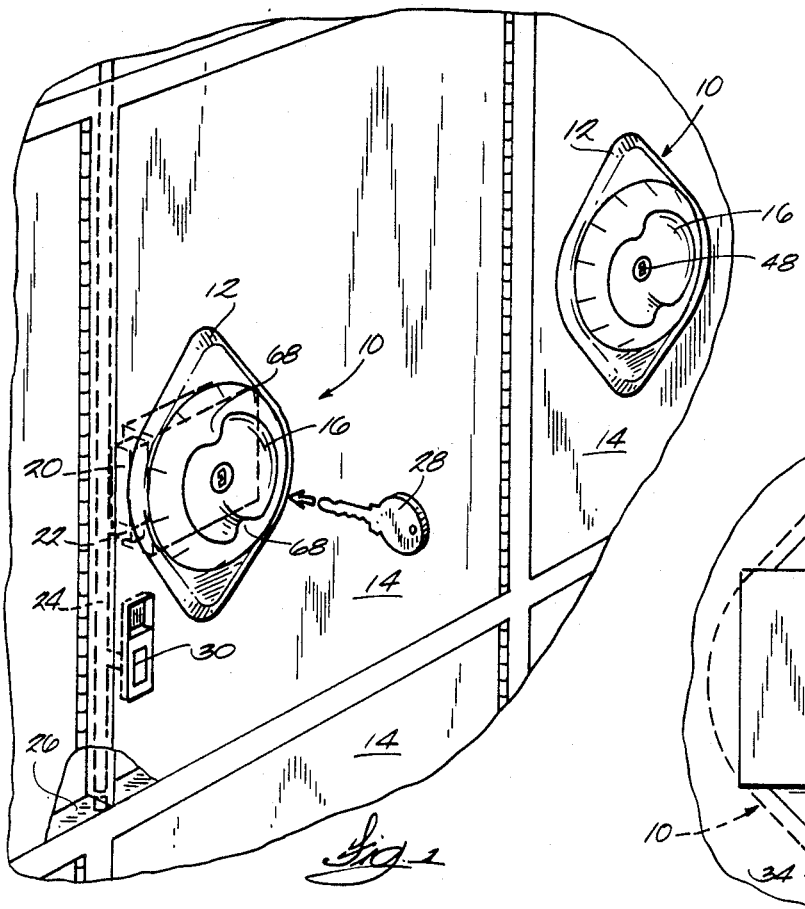
FIG. 1 is a perspective view of a representative combination lock mounted on a small locker door with the lock mechanism shown in dotted lines behind the door along with the locking rod.
Figure 4:
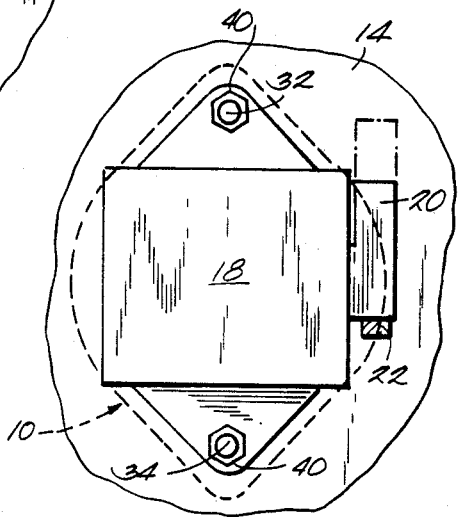
FIG. 4 is a rear view of the lock as mounted on the door.

FIG. 1 illustrates combination locks 10 mounted on locker doors. Each combination lock 10 has an escutcheon plate 12 mounted on the front of the locker door 14 with a rotary dial 16 mounted in the plate 12. The lock works are enclosed in the case 18 behind the locker door 14. The lock bolt 20 projects to one side of the case 18 and is vertically movable between the positions shown in full lines and dotted lines in FIG. 4. In the full line position in FIG. 4, the bolt is in the "locked" position and holds the lug 22 on rod 24 in a down position. This means that the bottom end of the rod 24 will be received in a cooperating hole in the frame 26 thus locking the door to the frame. When it is desired to open the locker either the combination lock is operated or a pass key 28 can be utilized to enable movement of the bolt 20 to the upper (dotted line) position shown in FIG. 4 in which position the lug is free for movement upwardly when the operator moves the actuator 30 upwardly. This will disengage the rod 24 from the frame 26 and the door can be opened.

The escutcheon plate 12 is mounted on the locker door 14 by means of two bolts 32, 34 projecting rearwardly from the escutcheon plate to pass through cooperating holes in the door and to also pass through holes 36, 38 in the upper and lower tabs of the lock case 18. A nut 40 is run down each bolt to complete the assembly.

The escutcheon plate 12 has an inwardly projecting annular shoulder 42 on which the dial 16 is rotatably mounted. The dial 16 has a rim portion 44 bearing indicia (0–50) which are moved relative to the index mark 46 on the escutcheon plate for purposes of operating the permutation lock to set the permutation discs in the correct position. It will be noted that the rim 44 is inclined at about 45° to the axis of the dial. The face 44 does not project very far from the escutcheon plate (about $\frac{1}{4}''$). This factor, coupled with the 45° slope, means that the face is positioned to deflect lateral blows delivered thereto.

Figure 8:
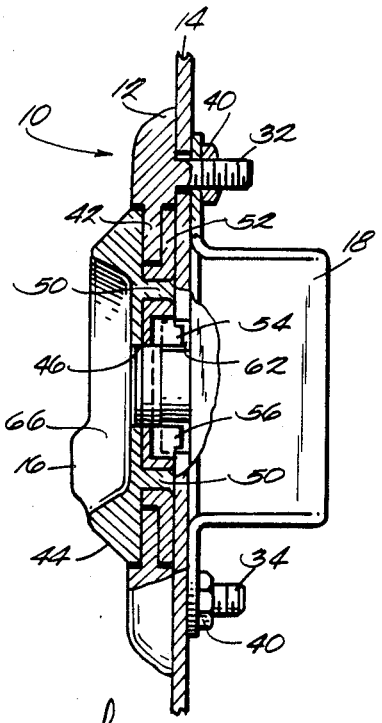
FIG. 8 is a vertical section through the lock assembly as mounted on the locker door.
Figure 9:
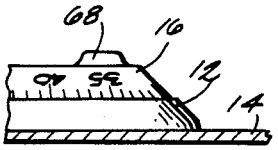
FIG. 9 is a section taken on line 9—9 of FIG. 2.

The outside edge of the dial face is recessed into the escutcheon plate as can be seen in FIG. 8. The dial has a round central opening 46 which permits access to the key slot 48 when utilizing key 28 to operate the lock. The dial has two rearwardly facing pins 50 which are received in cooperating holes on the rear plate 52. The heads of the pins 50 are peened or deformed to fix plate 52 relative to the dial while capturing the annular shoulder 42 of the escutcheon 12 between the dial 16 and the plate 52, thus providing a rotary mount for the dial.

The escutcheon plate and dial assembly is a separate assembly. Plate 52 is provided with two rearwardly projecting lugs 54, 56 which are received in cooperating slots 58, 60 on the driver 62 projecting through the cover plate 64 of the lock subassembly. The lugs 54, 56 are of different size, i.e., lug 54 is wider than lug 56 and slot 58 which receives lug 54 is wider than slot 60. This insures that the dial will be correctly oriented relative to the lock works when the assembly is completed. Therefore, the dial numbering will be correct relative to the lock works. The driver 62 in turn has its own lugs on the rear of the lock for engaging the disc drivers.

Figure 6:
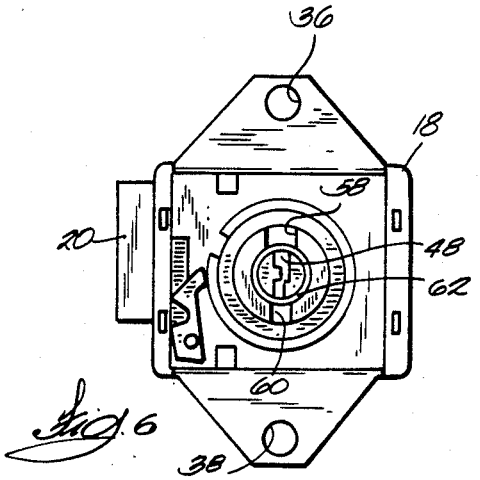
FIG. 6 is similar to FIG. 5 but shows the front cover of the casing removed to expose the lock works contained within the casing.

FIG. 6 shows cover 64 removed from the lock casing 18 which is mounted on the rear of the locker door. This view shows the lock works in general terms. More detailed information relative to this type of lock works can be seen in my U.S. Pat. No. 3,395,557. Additional details of the lock works are not necessary to understanding the present invention.

From the foregoing it will be apparent that the lock works are enclosed in casing 18 and lie wholly behind the locker door. The lock works are, therefore, protected by the locker door. The escutcheon plate is mounted on the locker door by means which expose no screw heads or the like to permit removal of the escutcheon plate from outside the door/locker. The dial rim slopes at 45° to deflect blows. The sides of the escutcheon plate also slope at about 45° and they also help deflect blows where the two angles line up. The dial only projects about $\frac{1}{4}''$ from the escutcheon plate. The shallow dial is permitted by reason of the fact that the lock works are entirely behind the locker door. Other combination locks enclose the lock works inside the knob and such locks must project a substantial distance in front of the locker door. They provide a good surface to hit either with the heel of a boot or some other solid object. When the knob is broken the lock works are exposed and the lock is rendered useless.

Figure 2:
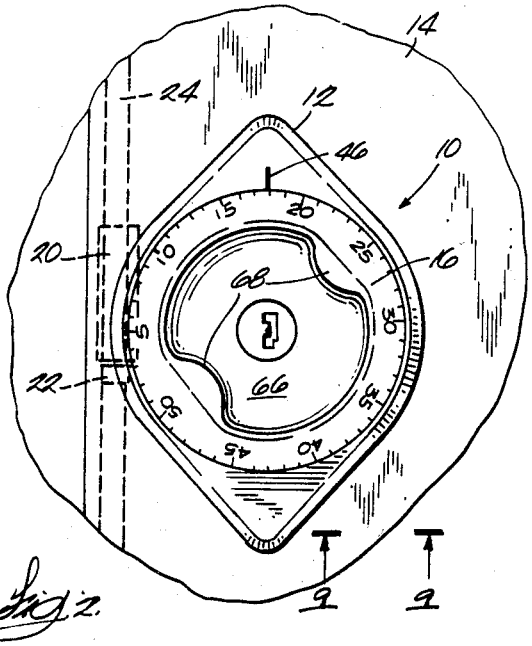
FIG. 2 is an enlarged front view of the lock mounted on the door with the lock bolt shown in dotted lines.
Figure 3:
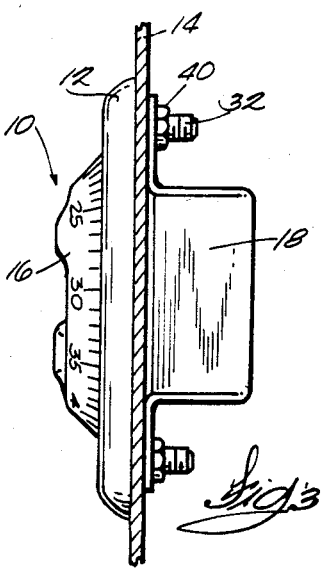
FIG. 3 is a vertical section through the door from one side of the combination lock.
Figure 5:
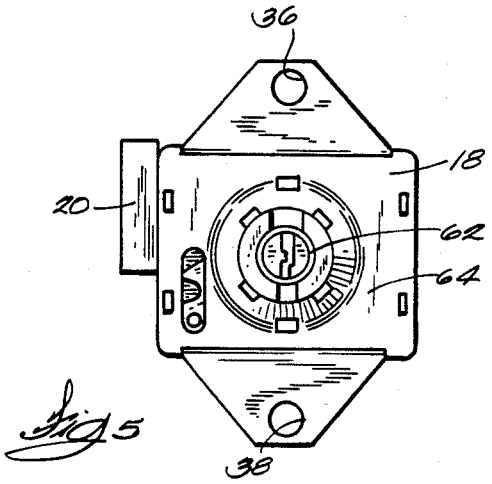
FIG. 5 is a front view of the casing enclosing the lock works. This casing is mounted on the rear of the locker door.
Figure 7:
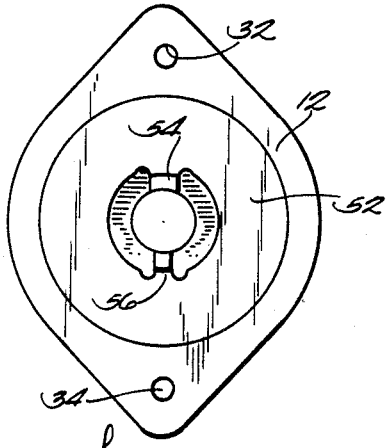
FIG. 7 is a rear view of the escutcheon plate assembly.

The present invention provides a structure in which the would-be thief cannot get a good "shot" at the dial to break the lock open. The dial is recessed at 66 in the center as shown in FIGS. 2 and 8 to permit the finger tips of the user to reach into the recess and engage the inward projections 68, 68 which serve as grip means. Either side of grips 68 can be engaged depending on the direction of rotation of the dial. It will be noted that provision for grips in the dial does not substantially increase the dial projection from the escutcheon plate. Therefore, the integrity of the lock arrangement is maintained.

While the description and drawings show the lock mechanism mounted behind and protected by a locker door it will be appreciated this invention is readily adapted to a padlock configuration. Therefore "door" in the claims is meant to embrace the steel front of a padlock.

I claim:

1. A combination lock comprising a case enclosing lock works including permutation discs and a key operated mechanism, said case being mounted behind and protected by a door, a key hole in the front of said case, an escutcheon plate mounted in front of said door, an axially fixed dial rotatably mounted in said plate, said dial having an inwardly and forwardly sloping rim and a central recess, a central hole in said dial aligned with said key hole, an index mark on said plate, and indicia on said rim to be brought into registry with said index mark as said dial is rotated.

2. A combination lock according to claim 1 including grip means in said recess to facilitate turning said dial.

3. A combination lock according to claim 2 in which said rim slopes at about 45° relative to the rotational axis of said dial to deflect impacts from the side.

4. A combination lock according to claim 3 in which said grip means are radially opposed and project inwardly from said rim to lie above the bottom of said recess.

5. A combination lock according to claim 1 including a permutation disc driver protruding from the front of said case, a slot in said driver, and a drive key on the rear of said dial engaging said slot.

* * * * *